United States Patent [19]

Rasmussen

[11] Patent Number: 4,929,023

[45] Date of Patent: May 29, 1990

[54] POSITION-ADJUSTING APPARATUS FOR MOUNTING A RECLINING CHAIR ON A PEDESTAL BASE

[76] Inventor: Lyle S. Rasmussen, 245 N. Vine St., Salt Lake City, Utah 84103

[21] Appl. No.: 323,309

[22] Filed: Mar. 14, 1989

[51] Int. Cl.[5] ..... A47C 1/00

[52] U.S. Cl. ..... 297/330; 297/354; 403/162

[58] Field of Search ..... 297/330, 354, 355, 260, 297/71, 68; 403/162; 248/615, 371, 372.1, 393, 503, 503.1

[56] References Cited

U.S. PATENT DOCUMENTS

| | | | |
|---|---|---|---|
| 3,637,186 | 1/1972 | Greenfield | 403/162 X |
| 4,318,568 | 3/1982 | Ericsson | 297/354 |
| 4,441,835 | 3/1984 | Davis | 403/162 X |
| 4,572,573 | 2/1986 | Yosikawa et al. | 297/330 X |
| 4,722,566 | 2/1988 | Castellini | 297/330 X |

*Primary Examiner*—Peter A. Aschenbrenner
*Attorney, Agent, or Firm*—Mallinckrodt & Mallinckrodt

[57] ABSTRACT

An improved reclining chair particularly for dental and medical patients utilizes structure and mechanism of a prior conversion unit for mounting such a chair on a pedestal base. Novel features that improve stability of the chair during use are provided. The conversion unit includes an elongate chassis frame having respective chair back and chair seat frame sections that are pivotally interconnected end-to-end and provided with a mounting plate adpated to fasten the unit to a pedestal base and on which the chassis frame is cradled for back or forth rocking movement under the control of the dentist, doctor, or other operator. The novel features are the mounting of a leaf spring to serve as a shock absorber for the chair seat frame section as it aproaches its lowermost position in the rocking movement of the chassis frame, the provision of a resilient interconnection between the two chassis frame sections for stabilizing the chair back frame section in its pivotal connection with the chair seat frame section, particularly as the chair back frame section moves into its lowermost position in the rocking movement of the chassis frame, and an especially rigid yet smooth working "hinge" arrangement between chair seat chassis frame section and chair back chassis frame section.

16 Claims, 3 Drawing Sheets

POSITION-ADJUSTING APPARATUS FOR MOUNTING A RECLINING CHAIR ON A PEDESTAL BASE

BACKGROUND OF THE INVENTION

1. Field:

The invention is in the field of reclining chairs for dental and medical patients and especially of so-called "conversion units" whereby modern styles of chairs of this type can replace older chairs on existing pedestal bases.

2. State of the Art:

Conversion units for such chairs have in most instances utilized the old mechanism contained in the pedestal base. However, several years ago, I designed an advanced type of conversion unit which contained its own position-adjusting mechanism. The mechanism of that conversion unit comprised a mounting plate, for fixed attachment to the existing pedestal base, and an articulated, elongate, two section, chassis frame containing an easily replaceable power package. Linkage mechanism, operable through a master bell crank that was pivotally attached to an end of a reciprocating motivator, rocked the chassis frame relative to the mounting plate on which the chassis frame was cradled to adjust the position of the chair to the work to be performed on the reclining patient.

3. Objective:

A principal objective in the making of the present invention has been retention of the advantageous features of such advanced type of conversion unit while providing improved stability for the so-mounted chair.

SUMMARY OF THE INVENTION

A feature of the invention in accomplishing the foregoing objective is resilient coupling of the pivotally attached back and seat frame sections of the chassis frame to one another.

The resilient coupling is accomplished by the provision of a transverse, rigid shaft between and pivotally mounting one set of corresponding ends of at least a pair of transversely spaced rods that pass through correspondingly spaced bracket members affixed to the chair seat frame section of the chassis frame. The shaft is pivotally attached to the chair back frame section of the chassis frame and the rods carry coil springs, respectively, between and with opposite ends bearing against shaft and bracket members for compression as the chair back frame section is rocked to its lowermost position. The motion-imparting linkage is pivotally attached to the shaft.

Further features for achieving improved stability are the relocation of a transverse leaf spring so that its ends are below the chair seat section of the chassis frame, rather than above, and the replacement of the former "hinging" device pivotally interconnecting the two chassis frame sections at opposite sides of the chassis frame with a uniquely rigid interconnection that still provides the required "hinge" movement.

THE DRAWINGS

The best mode presently contemplated for carrying out the invention commercially is illustrated in the accompanying drawings, in which:

FIG. 1 represents a perspective view of an upholstered dental chair incorporating the conversion unit of the invention applied to an existing pedestal base;

FIG. 2, a top plan view of the conversion unit per se, with the chair back frame section raised and with the pedestal indicated by broken lines;

FIG. 3, a righthand end elevation looking from the line 3—3 of FIG. 2 but shown as projected from FIG. 2;

FIG. 4, a longitudinal vertical section taken along the line 4—4 of FIG. 2;

FIG. 5, a view corresponding to that of FIG. 4 but with the chair back lowered and the chair seat raised; and FIG. 6, a fragmentary vertical section taken along the line 6—6 of FIG. 5 and drawn to a larger scale.

DETAILED DESCRIPTION OF THE ILLUSTRATED EMBODIMENT

Figure 1:
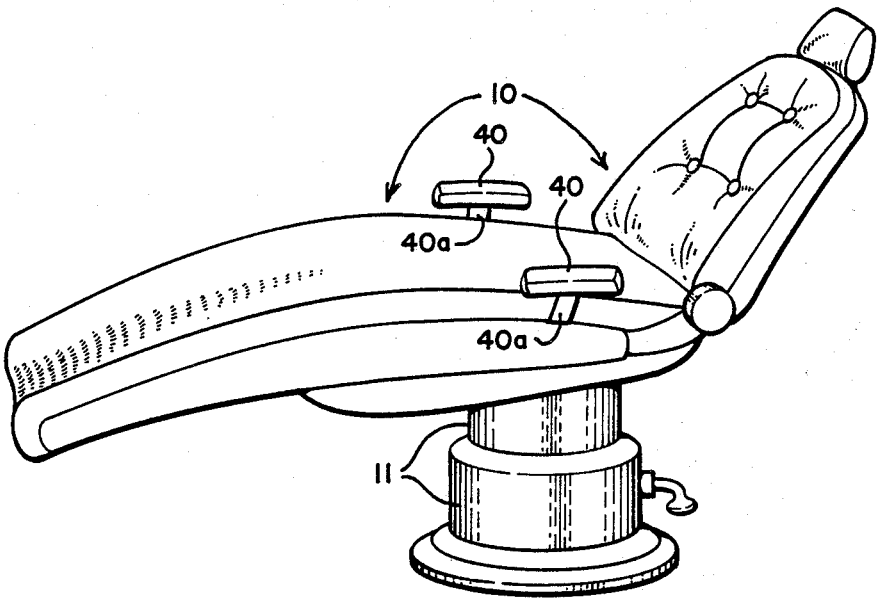

As shown in FIG. 1, an upholstered conversion unit 10 of the invention constituting a modern, reclining, dental chair is mounted in usual manner on a typical existing pedestal base 11 from which an older style dental chair had been removed.

Figure 3:
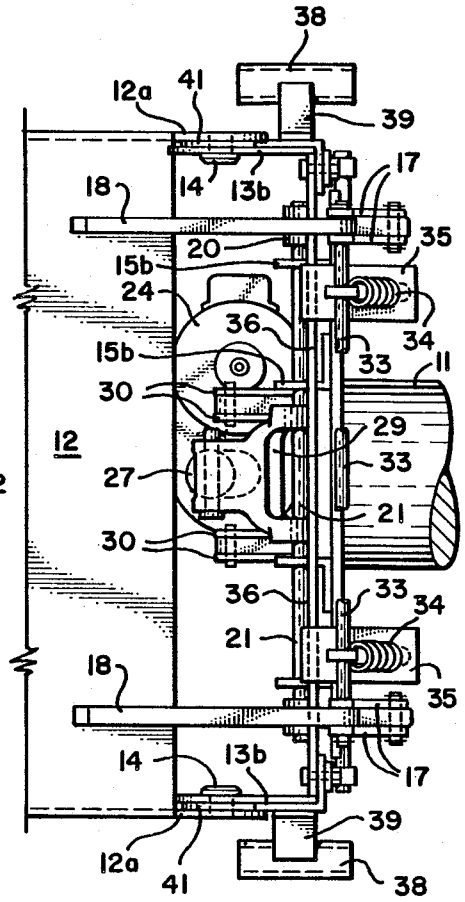
Figure 2:
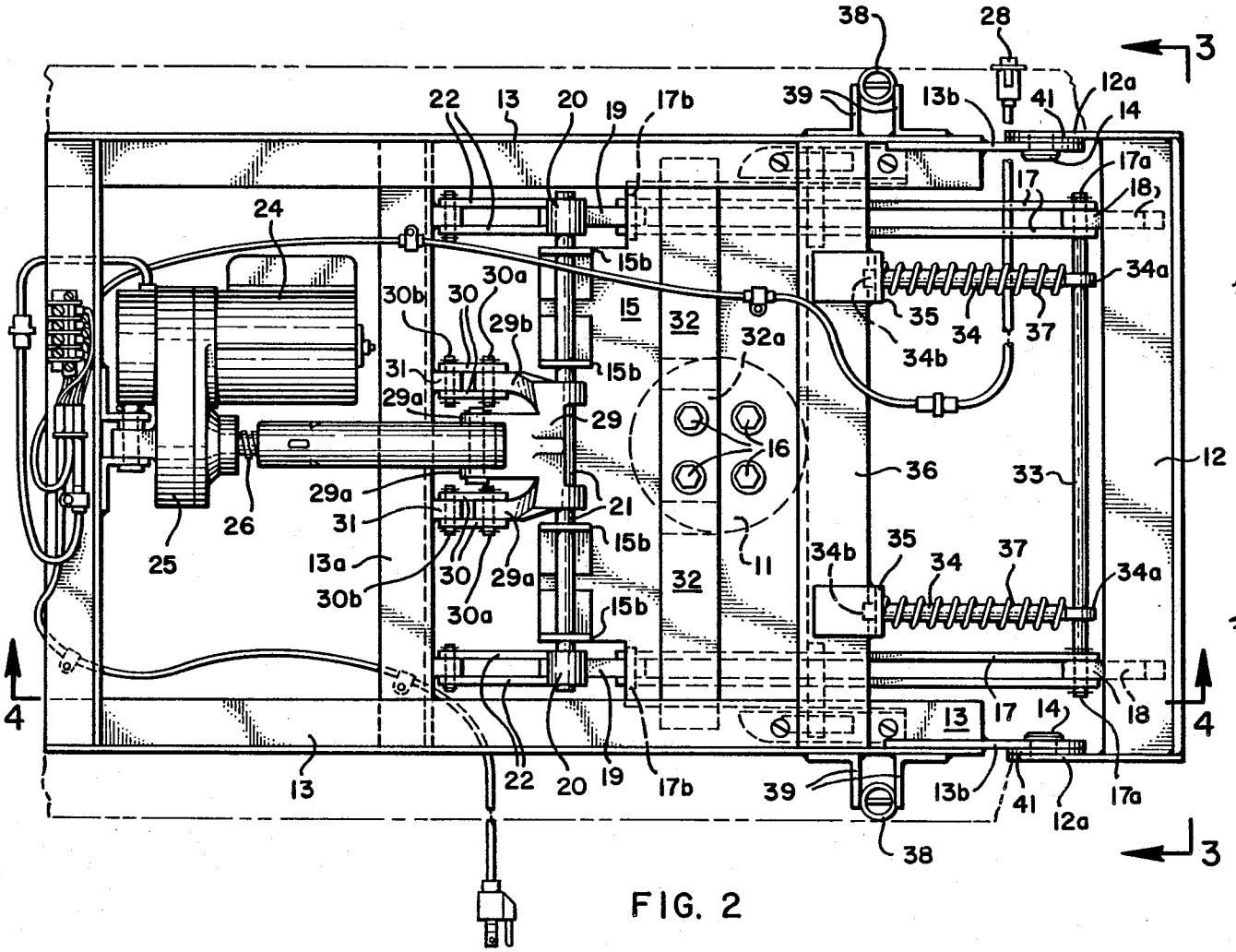
Figure 4:
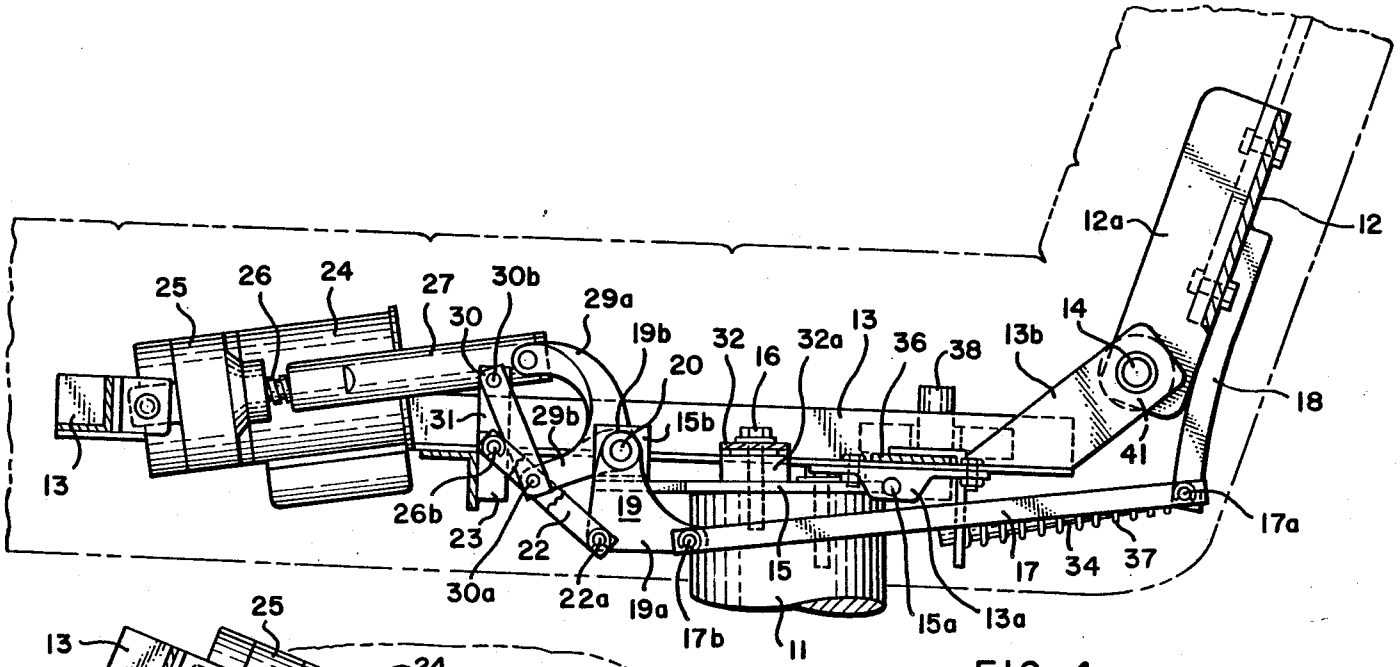

In the present embodiment of the invention shown in FIGS. 2–4, articulatively joined chair back and chair seat chassis frame sections 12 and 13, respectively, of an elongate chassis frame are pivotally connected to each other end-to-end at opposite sides, but with ends overlapped, by respective pivot pins 14. These, contrary to the spring-loaded "hinge" arrangements previously used, enable the chair back to be fully lowered to the horizontal position shown in FIG. 5.

Figure 6:
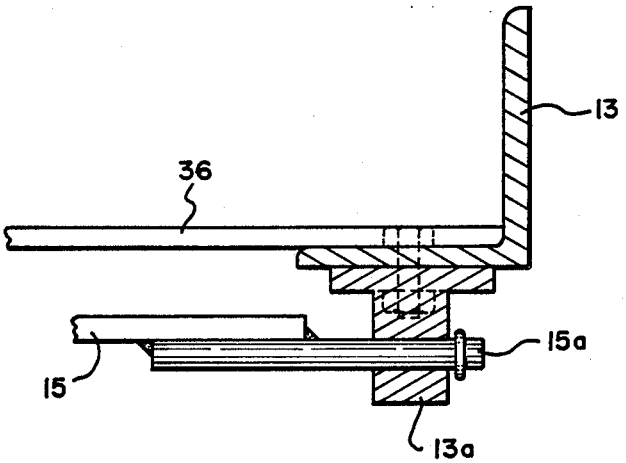

Both frame sections are rectangular in configuration, but the chair back frame section 12 is relatively short compared to the chair seat frame section 13, which is longer so as to accommodate and support the lower trunk and legs of a patient in a reclining position. Extending transversely beneath frame section 13, adjacent to but at a level below frame section 12, is a heavy mounting plate 15 provided with holes for receiving bolts 16 used in attaching the conversion unit to the base pedestal 11. Such mounting plate is pivotally attached to frame section 13 at the opposite ends of its edge lying closest to frame section 12, by pivot pin extensions **15*a*, respectively, FIG. 6, passing through bearing blocks 13*a* that are attached to and depend from frame section 13**, see also FIGS. 4 and 5.

The two frame sections 12 and 13 are articulatively interconnected for movement relative to each other by a pair of double links 17, respectively, that extend longitudinally of mounting plate 15 below such plate. Each set of such double links 17 is pivotally connected at one end **17*a* to a corresponding arm 18 depending rigidly from frame section 12 at a side thereof and, at the other end 17*b*, to the lower arm 19*a* of a corresponding bell crank 19 at the same side of the frame section. The upper arm 19*b* of the bell crank is pivotally connected at 20 to a corresponding end of a transverse rocker shaft 21, which is itself journaled by transversely spaced bracket members 15*b* upstanding from fixed attachment, as by welding, to the upper surface of mounting plate 15. Bell cranks 19 are pivotally attached to a cross-member 13*a* of chassis frame section 13 by pairs of double links 22, which have one set of ends pivotally attached at 22*a* to a corresponding bell crank 19 intermediate the arms thereof and the other set of ends pivotally attached at 22*b* to a corresponding lug 23 projecting fixedly from frame cross-member 13*a*. Accordingly, chassis frame section 13 is cradled intermediate its length by rocker shaft 21** for back or forth movement about it as an axis.

Chassis frame section 13 is rocked about its cradle mounting axis, provided by transverse shaft 21, by means of a power package replaceably fastened in such frame section 13 and comprising a reversible motor 24, a gear box 25, and an elongate screw-threaded power output shaft 26 that extends and is screwed into an internally threaded actuator tube 27. As motor 24 rotates shaft 26 in one direction, it pulls tube 27. In the other direction it pushes tube 27. Thus, tube 27 reciprocates back or forth as power is applied to motor 24 for driving it in one direction or the other under the control of the dentist operating a push button 28 in the electrical circuitry supplying power to the motor.

The free end of actuator tube 27 is pivotally secured between dual upper arms **29*a*, respectively, of a master bell crank 29, whose dual lower arms 29*b*, respectively, are pivotally fastened at 30*a* to one set of ends of corresponding sets of double links 30, the opposite set of ends of such sets of double links 30 being pivotally fastened at 30*b* to corresponding arms of a set of transversely spaced arms 31 rising from rigid securement, as by welding, to frame cross-member 13*a*. Master bell crank 29 is journaled between its arms 29*a* by rocker shaft 21. Accordingly, as drive tube 27 reciprocates, it either lifts or lowers that end portion of chassis frame section 13 to which master bell crank 29 is attached and concurrently lowers or lifts the opposite end portion of such chassis frame section 13** positioned on the opposite side of the rocker axis.

For the purpose of enhancing stability of the chair, it is especially advantageous that a leaf spring 32 be fastened along with mounting plate 15 to pedestal base 10 by some, here two, of the bolts 16 and that it extend transversely across, but with its opposite ends below, chassis frame section 13 so as to be free to descend relative to its midportion for cushioning the approach of such chassis frame section to such pedestal base. A block **32*a* is interposed centrally of and between leaf spring 32 and mounting plate 15 to support the midportion of such spring and prevent its descent, thereby enabling spring to act as a shock absorber under the impact of chassis frame section 13. The leaf spring attachment bolts 16 pass through block 32*a*** to hold it in place.

For the purpose of better stabilizing the chair in adjusted positions thereof and during positional adjustments thereof, the means constituting the pivotal connections **17*a* of the double links 17 with the depending arms 18 of chassis frame section 12 is a transverse shaft 33, and pivotally attached to such shaft in transversely spaced relationship is one set of ends 34*a* of a pair of transversely spaced, longitudinal rods 34, respectively, whose opposite ends 34*b* pass slidably through receiving openings in corresponding bracket members 35 of a pair of such bracket members depending from rigid securement, as by welding, to a frame cross-member 36 positioned across chassis frame section 13 adjacent to chassis frame section 12. Additional rods may be provided, e.g. a third one intermediate the two shown in an embodiment of chair in which the seat section remains horizontal and is not moved relative to the back section. Positioned on such longitudinal rods 34, for compression and expansion between shaft 33 and bracket members 35 as chassis frame section 12 is lowered and raised, respectively, are respective coil springs 37**.

Tubular fittings 38 are carried in fixed positions laterally of chassis frame 13 by brackets 39 welded to the side members of frame 13 for receiving rigid attachment posts **40*a*, respectively, FIG. 1, of upholstered arm rests 40**.

The manner in which chassis frame section 12 is "hinged" to chassis frame section 13 should be noted. Thus, chassis frame section 13 has end members **13*b* rigidly fastened as by welding to opposite sides thereof, respectively, FIGS. 4 and 5, and angled upwardly in elbow fashion to receive, in overlapping relationship adjacent their free ends, side members 12*a*, respectively, of chassis frame section 12, through which overlapped members the pivot pins 14 extend from fixed securement to the free end portion of frame member 13*b*. Interposed between the overlapped frame members of each set is a slippery faced washer 41, preferably of "Teflon" plastic adherant to the confronting face of overlapping frame end member 13*b*, pivot pin 14 being preferably molded or otherwise securely fixed to the overlapping portion of side member 12*a* of chassis frame section 12 and having its free end upset in pivot fashion against the confronting face of end frame member 13*b***. This arrangement could, of course, be reversed.

Figure 5:
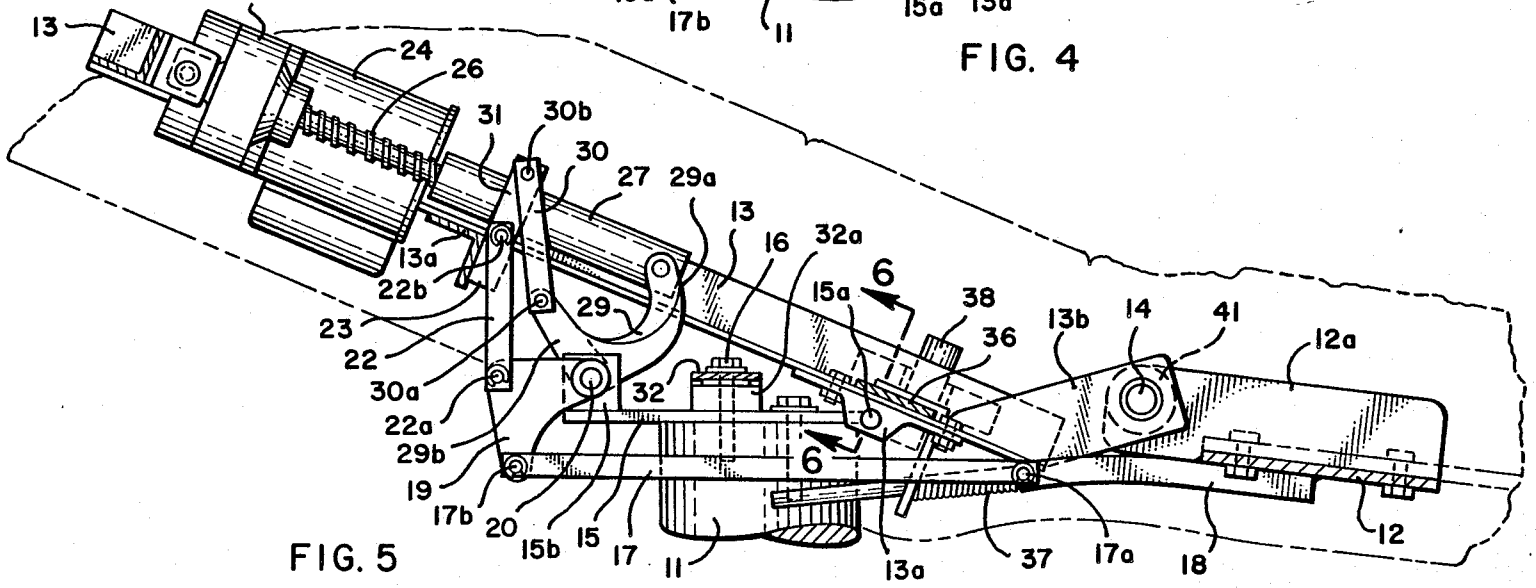

Also, by mounting the transverse leaf spring 32 under chassis frame 13 so its opposite ends are beneath the longitudinal side members of chassis frame section 13, as indicated in FIGS. 2 and 5, such chassis frame section 13 is cushioned by spring 32 acting as a shock absorber as such chassis frame section 13 descends toward the mounting pedestal 11. This is an important feature in achieving improved stability over the earlier forms of conversion unit wherein a similar leaf spring had its end mounted above chassis frame section 13.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A conversion unit for pedestal mounted, reclining chairs, comprising an elongate chassis frame having a chair seat frame section and a chair back frame section interconnected end-to-end for pivotal movement relative to each other; means pivotally interconnecting the two frame sections; a mounting plate intermediate the length of said chassis frame for fixed attachment to a pedestal base; motivating mechanism supported by said frame for rocking said chassis frame either backwardly or forwardly along its longitudinal axis and including a reversible electric motor, a screw extending longitudinally of said frame, and an elongate actuator arranged to be moved back or forth by said screw; master bell crank means; means pivotally interconnecting said master bell crank means with said actuator; linkage means pivotally interconnecting said master bell crank means with said chair seat frame; a rocker shaft extending transversely of said chair seat frame section, said shaft being carried by said mounting plate and journaled by said master bell crank means; respective secondary bell crank means pivotally connected to opposite ends, respectively, of said shaft; a second transverse shaft; structural means extending from fixed connection with said chair back frame section to pivotal connection with opposite ends, respectively, of said second transverse shaft; respective second linkage means pivotally interconnecting said secondary bell crank means with opposite ends of said second transverse shaft, respectively; respective third linkage means pivotally interconnecting said secondary bell crank means, respectively, with said chair seat frame section; respective bracket members fixedly secured to said chair seat frame section in mutually spaced relationship transversely of said chassis frame; respective rods extending longitudinally of each chassis frame and having one set of corresponding ends pivotally attached to said second transverse shaft, the opposite set of corresponding ends passing slidably through said bracket members, respectively; and respective coil compression springs carried longitudinally by said rods, respectively, with their opposite ends abutting said second transverse shaft and said bracket members, respectively.

2. A conversion unit according to claim 1, including a leaf spring extending transversely across the chassis frame with its opposite ends below the chair seat frame section and free to descend but with its midportion supported against descent, and leaf spring being adapted to be secured along with said mounting plate to the pedestal base, for absorbing shock as said chair seat frame section approaches its lowermost position of the rocking movement.

3. A conversion unit according to claim 2, wherein the mounting plate is provided with bolt holes, for receiving bolts used to attach the unit to a pedestal base, some of which bolt holes are arranged to receive bolts used to secure the leaf spring to the base plate and the pedestal base.

4. A conversion unit according to claim 2, wherein a supporting block is interposed between the leaf spring and the mounting plate centrally of the length of said leaf spring as the support against descent.

5. A conversion unit according to claim 1, wherein the bracket members are fixedly secured to and depend from a transverse frame member that is fixedly secured at its ends to the chair seat frame section.

6. A conversion unit according to claim 1, wherein the end-to-end interconnection between the chassis frame sections is between overlapped end portions of side members of the respective chassis frame sections, those end portions of the side members of the chair seat chassis frame section being angled upwardly for the purpose; and wherein the means interconnecting the two frame sections are pivots extending between the overlapped frame side members, respectively, each pivot comprising a pivot pin having one end fixed in one of said side members, passing through and journaling the other of the overlapped side members, and having its other end upset against the confronting face of said other side member, and a slippery-faced washer between the overlapped side members and adherant to one of them.

7. A conversion unit for pedestal mounted, reclining chairs, comprising an elongate chassis frame having a chair seat frame section and a chair back frame section interconnected end-to-end for pivotal movement relative to each other; means pivotally interconnecting the two frame sections; a mounting plate intermediate the length of said chassis frame for fixed attachment to a pedestal base; means cradling said chassis frame on said mounting plate for longitudinal rocking movement; motivating means for rocking said chassis frame back or forth; means articulatively interconnecting said chair back frame section with the adjacent end portion of the chair seat frame section for lowering and raising said chair back frame section relative to said chair seat frame section adjacent the lowermost position of said chair seat frame section in the rocking movement of said chassis frame; and a leaf spring extending transversely across said chassis frame with its opposite ends below said chair seat frame section and free to descend but with its midportion supported against descent, said leaf spring being adapted to be secured along with said mounting plate to the pedestal base, for absorbing shock as said chair seat frame section approaches its lowermost position in the rocking movement of said chassis frame.

8. A conversion unit according to claim 7, wherein a supporting block is interposed between the leaf spring and the mounting plate centrally of the length of said leaf spring as the support against descent.

9. A conversion unit according to claim 7, wherein the means articulatively interconnecting the chair back frame section with the chair seat frame section comprises a shaft extending transversely of said chair back frame section and having its ends pivotally connected thereto; respective bracket members fixedly secured to said chair seat frame section in mutually spaced relationship transversely of the chassis frame; respective rods extending longitudinally of said chassis frame and having one set of corresponding ends pivotally attached to said shaft, the opposite set of corresponding ends passing slidably through said bracket members, respectively; and respective coil compression springs carried longitudinally by said rods with their opposite ends abutting said shaft and said bracket members, respectively.

10. A conversion unit according to claim 9, wherein the bracket members are fixedly secured to and depend from a transverse frame member that is fixedly secured at its ends to the chair seat frame section.

11. The combination of the structure and mechanism of a conversion unit according to claim 1, with an upholstered reclining chair seat and chair back, and with a pedestal base on which the conversion unit is mounted.

12. The combination of the structure and mechanism of a conversion unit according to claim 7, with an upholstered reclining chair seat and chair back, and with a pedestal base on which the conversion unit is mounted.

13. In an upholstered reclining chair particularly adapted for dental and medical patients, an elongate, chassis frame for mounting said chair on a pedestal base, said frame having a chair seat section and a chair back section with respective pairs of side frame members having end portions that are overlapped with respective faces in mutually confronting relationship; and means articulatively interconnecting said frame sections, said means including a hinge arrangement between the overlapped end portions of the side frame members of said frame sections which comprise, for each of said overlapped end portions, a pivot pin rigidly affixed to one of the end portions and passing through the other of the end portions as a journal therefor; and a slippery faced washer entirely interposed between the confronting faces of the two end portions and journaled on said pivot pin only within the span between said confronting faces, the free end of said pivot pin being upset against the adjacent end portion to hold the two end portions securely together against wobble but with minimum friction.

14. The combination set forth in claim 13, wherein the slippery faced washer has one face adherant to the confronting face of the end portion of a side frame member.

15. The combination according to claim 13, wherein the washer is of a plastic material.

16. In an upholstered reclining chair particularly adapted for dental and medical patients, and elongate, chassis frame for mounting said chair on a pedestal base, said frame having a chair seat section and a chair back section with respective side frame members having end portions that are overlapped; and means articulatively interconnecting said frame sections, said means including a hinge arrangement between the overlapped end portions of the side frame members of said frame sections which comprise, for each of said overlapped end portions, a pivot pin rigidly affixed to one of the end portions and passing through the other of the end portions as a journal therefor; and a slippery faced washer interposed between the two end portions on said pivot pin, the free end of said pivot pin being upset against the adjacent end portion to hold the two end portions securely together against wobble, wherein the means articulatively interconnecting the frame sections further includes a shaft extending transversely of said chair back section and having its ends pivotally connected thereto; respective bracket members fixedly secured to said chair seat section in mutually spaced relationship transversely of the chassis frame; respective rods extending longitudinally of said chassis frame and having one set of corresponding ends pivotally attached to said shaft, the opposite set of corresponding ends passing slidably through said bracket members, respectively; and respective coil compression springs carried longitudinally by said rods with their opposite abutting said shaft and said bracket members, respectively.

* * * * *